United States Patent [19]

Shipman, III

[11] Patent Number: 4,750,869

[45] Date of Patent: Jun. 14, 1988

[54] METHOD AND APPARATUS FOR BOOSTING GAS FROM A LOW-PRESSURE SOURCE TO A HIGH-PRESSURE RECEPTACLE

[75] Inventor: Lawrence A. Shipman, III, Greencastle, Ind.

[73] Assignee: Booster Technologies, Inc., Greencastle, Ind.

[21] Appl. No.: 842,075

[22] Filed: Mar. 20, 1986

Related U.S. Application Data

[63] Continuation of Ser. No. 608,432, May 9, 1984, abandoned.

[51] Int. Cl.[4] ..... F04B 35/02

[52] U.S. Cl. ..... 417/342; 417/345; 417/347

[58] Field of Search ..... 417/342, 344, 345, 346, 417/392, 395, 347

[56] References Cited

U.S. PATENT DOCUMENTS

| | | | |
|---|---|---|---|
| 636,013 | 10/1899 | Tolle | 417/345 |
| 912,888 | 2/1909 | Pulliam | 417/392 |
| 1,689,557 | 10/1928 | Nordell | 417/390 |
| 2,141,731 | 12/1938 | Wolfrom et al. | 417/345 X |
| 2,260,127 | 10/1941 | Tebbetts, Jr. | 417/452 |
| 2,897,762 | 8/1959 | Houvener | 417/387 |
| 3,082,698 | 3/1963 | Smith | 417/142 |
| 3,303,786 | 2/1967 | Fanshawe | 417/392 |
| 3,572,035 | 3/1971 | Beroset et al. | 417/392 |
| 3,619,087 | 11/1971 | Beeman | 417/390 |
| 3,680,982 | 8/1972 | Jacobellis | 417/392 |
| 3,994,627 | 11/1976 | Calzolari | 417/344 X |

*Primary Examiner*—Carlton R. Croyle
*Assistant Examiner*—T. Olds
*Attorney, Agent, or Firm*—Woodard, Emhardt, Naughton, Moriarty & McNett

[57] ABSTRACT

Method and apparatus for transferring and boosting the pressure of gas from a source to a receptacle by sequentially filling and compressing volumes of gas by displacing same with a fluid available at a higher pressure and utilizing pressure differential between the gas and fluid to signal the filling and compressing cycles.

4 Claims, 4 Drawing Sheets

METHOD AND APPARATUS FOR BOOSTING GAS FROM A LOW-PRESSURE SOURCE TO A HIGH-PRESSURE RECEPTACLE

This application is a continuation, of application Ser. No. 608,432, filed May 9, 1984, now abandoned.

The present invention relates to an improved method and apparatus for boosting the pressure in a fluid and transferring it from a source at one pressure to a receptacle at a higher pressure. More specifically, the invention is an improved method and system of apparatus for hydraulically boosting the pressure on a gas while transferring it from a source at one pressure to one or more receptacles at a higher pressure.

There is a vast need for manageable quantities of compressed gases for use in industry, recreation, safety and health care services and the like. Usually, such gases are supplied to the point of use in highly pressurized vessels ranging in size from 20 to 468 cu.ft. (standard atmosphere volume capacity) which, according to the particular application are pressurized from about 22 PSIG to about 4500 PSIG. Such pressurized tanks most commonly are constructed of steel; however, tanks of newer design are constructed of aluminum, stainless steel and also wound fiberglass. Such tanks may contain, under pressure, from about 38 to about 260 cu.ft. of pressurized gas.

Notable examples are helium, hydrogen, oxygen, nitrogen and carbon dioxide used in industry, oxygen used in medicine, air, oxygen and natural gas used for recreation and sport applications, and air and oxygen used in safety applications such as resuscitators and fire fighters lifepacks.

The tanks of such gases normally, however, are filled from large volume supplies often held at high pressure less than the optimum permissible utilization tank pressure. Thus, unless there is a way to boost the gas into the utilization tanks at higher pressure, there will be inefficiencies and losses in the distribution of the gas. A striking example is the distribution of helium, a relatively expensive gas, which is available in commercial quantities in the United States from one or very few sources located in Texas. Normally, helium is transported by tank truck containing 40- to 160-thousand cu.ft. of gas maintained at 2800–3000 PSIG. The tank trucks are transported to metropolitan and industrial centers where it is the usual practice to transfer the helium into use tanks containing 220–260 cu.ft. pressurized at up to about 2400 PSIG. Such tanks may be filled from the truck without boosting the pressure until only about 40% and possibly a maximum of 60% of the helium has been transferred; and thereafter the tanks may only be filled to inefficient lower pressures and contents. Most often the helium tank trucks will return to Texas containing approximately 50% of the original helium load which heretofore could not be economically transferred to use tanks.

There are also a number of situations where efficient transfer of gas is not so important as the need for having the capacity to transfer and boost the pressure of gas into utilization cylinders at or close to the location at which the used cylinders are employed. Scuba divers need such a capacity to refill their diving tanks at dockside or, even more advantageous, on the water. Firefighters and disaster teams are greatly aided if their life support systems may be replenished at or near the site of a fire or accident or other emergency.

Accordingly, it is an object of the present invention to provide an improved method and apparatus for boosting gas from a source at one, relatively lower, pressure into a receptacle at a relatively higher pressure.

It is a further object of the present invention to provide an improved method and apparatus for recompressing gas from a source at one pressure to a higher pressure while maintaining the power demand of such compression at a low level.

It is still another object of the present invention to provide for the semicontinuous compression of volumes of gas at one pressure to smaller volumes at a higher pressure by displacing the gas with hydraulic fluid available to an even higher pressure.

In general, the present method involves first receiving an initial volume of gas at one pressure into a zone and then compressing that volume of gas while permitting the gas to escape only at a second higher pressure from the zone to a receptacle, the compressing being accomplished by displacing the gas with a fluid available from a source at a still higher third pressure while sensing the pressures in both the gas and fluid and releasing the fluid upon the pressure therein exceeding the pressure in said gas, thereby enabling a further volume of gas to refill the zone at the first pressure, and the cycle is then repeated. A preferred system of apparatus for performing this method comprises one or more receiving vessels which accept gas from a supply at one pressure and wherein a hydraulically powered compressing means is provided within the vessels to receive fluid from a control means which is operable to alternately connect the compressing means to a pressurized fluid source and to a reservoir; and wherein the control means is connected to be operated by a sensing means which is connected to detect the relative pressure of each of the gas and fluid in the vessel and compressing means.

Further objects and advantages of the present invention will become apparent upon reading the following detailed description in conjunction with the drawings wherein FIG. 1 is a schematic layout of a preferred system of apparatus;

In practicing the preferred method of the present invention, it is contemplated that a gas will be boosted from one pressure (usually greater than atmospheric) and transferred to a receptacle at a higher pressure by displacing and thereby compressing the gas with a hydraulic fluid. However, it will become apparent that the invention may be modified to be applicable to other fluids, both gas and liquid, and combinations of such fluids. Moreover, it is to be understood that while it is intended that gas be transferred to a receptacle at a higher pressure, the pressure in the receptacle will increase gradually as it is filled and thus the compressing and transfer of gas is undertaken in a substantially continuous cycle of steps where the output of gas is in increments of gradually increasing pressure. Thus a continuous series of initial volumes of a gas are first received in a compression zone and therein compressed to a smaller volume and higher, second, pressure by displacing (or partially displacing) the initial volume with a fluid available at a third, still higher, pressure. The compression is not instantaneous and may, indeed, occur over a period of several to many seconds and thus the power required to pressurize and deliver the displacing fluid need not be high.

The pressures of both the gas under compression and the compressing-displacing fluid is sensed and continuously compared so as to detect reversals in the pressure differentials as between the gas and the compressing fluid. That is to say that to control the compression cycles it is not necessary to know the actual pressures existing at any given time but it is necessary to detect and generate a signal at the points at which the gas pressure exceeds the pressure of the compressing fluid (during the period through which the compression zone is filled with gas) and the point at which the pressure of the compressing fluid exceeds the pressure of the gas (which occurs when the gas in the compression zone equalizes with the pressure of gas in the receptacle being filled or when the compression means reaches its limit of compression and is mechanically stopped). When the latter occurs a signal is generated to cause the compression fluid to be diverted from the compression means and the pressure thereon reduced so as to permit the compression zone to be refilled with gas at the initial pressure and for the cycle to thereafter repeat.

Preferably, two or more compression zones are filled and compressed, as hereinbefore described, sequentially so as to deliver a substantially continuous flow of pressurized gas to the receptacle (which may actually comprise a plurality of receptacles ganged in parallel) and in which case the signal generated upon the pressure of the compressing fluid in a successive compression zone exceeding the pressure of gas therein, will trigger the reintroduction of pressurized hydraulic fluid to a preceding compression zone.

Figure 1:
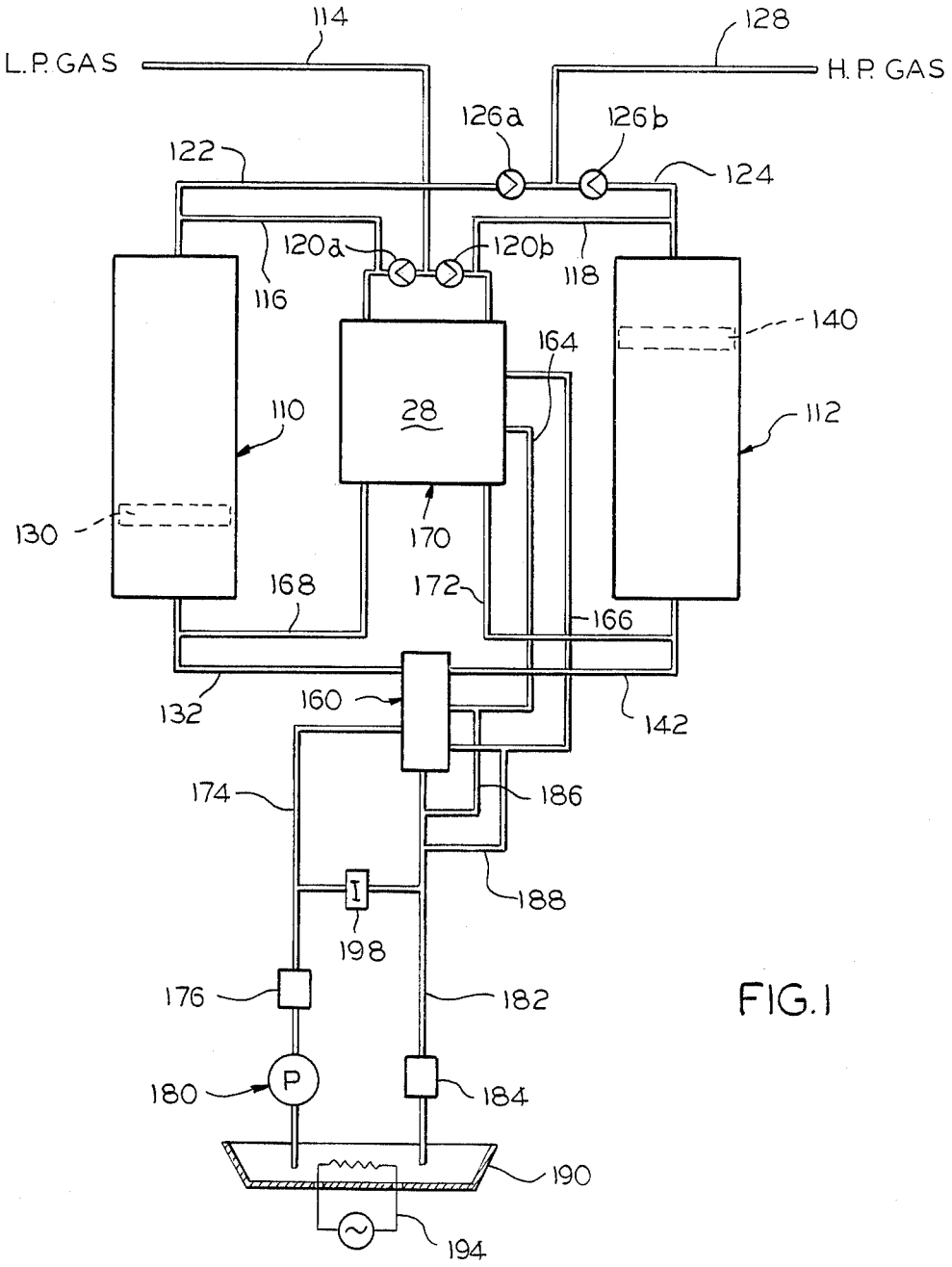

A preferred system of apparatus for performing the aforedescribed method is shown in FIG. 1 wherein first and second gas receiving vessels generally 110,112 are connected to a low-pressure gas main 114 by way of inlet conduits 116 and 118, respectively, through check valves **120*a* and 120*b*, respectively, which are biased to prevent the backflow of higher pressure gas into the low pressure gas main 114. Each of the gas receiving vessels generally 110,112 is connected by respective high-pressure outlet conduits 122 and 124 through check valves 126*a* and 126*b* to a high pressure gas main 128 leading to one or more high pressure gas receptacles (not shown). Check valves 126*a* and 126*b* are biased to prevent return of gas from the high pressure main 128 when the pressure in the vessels 110,112 (and conduits 122,124**) cycles to a lower pressure.

In gas receiving vessel generally 110 there is a compressing means generally 130 which is supplied by fluid through a hydraulic conduit 132; and similarly in gas receiving vessel generally 112 there is a corresponding compressing means generally 140 which is supplied with fluid through hydraulic conduit 142.

Figure 2:
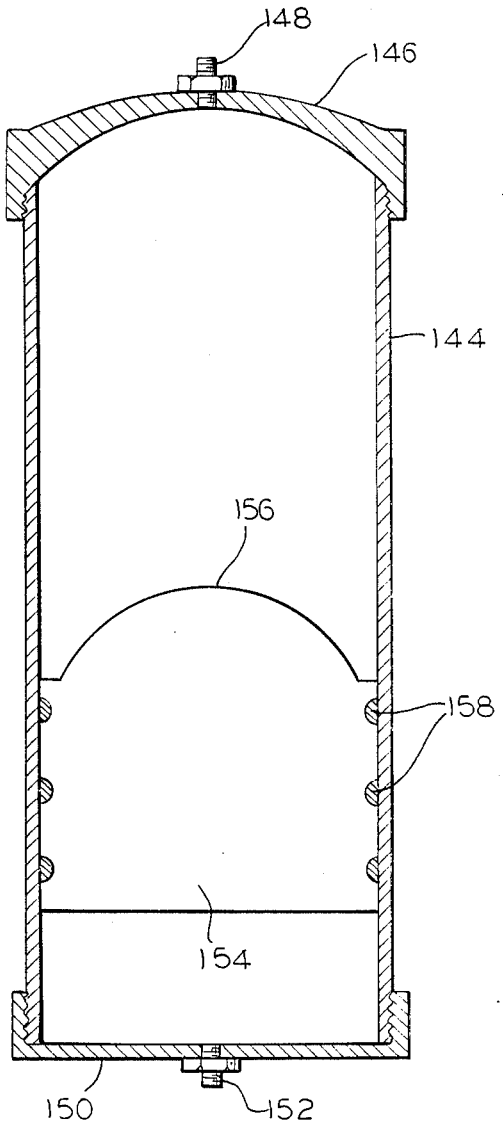
FIG. 2 is a sectional elevation view of one embodiment of a gas receiving vessel and compressing means.

One embodiment of a gas receiving vessel may be seen in FIG. 2 wherein a cylinder 144 is threaded at each end and has a domed gas cap 146 threaded on one end. A gasline connector 148 is secured to the gas cap 146 and may be connected to conduits 116 and 122 of the system shown in FIG. 1. A hydraulic cap 150 is threaded to the opposite end of cylinder 144 and contains a hydraulic connector 152 which, similarly, may be connected to hydraulic conduit 132 in the system of apparatus shown in FIG. 1. Within the cylinder 144 there is a free-floating piston 154 which has a dome 156 at the gas side corresponding to the shape of the gas cap 146. The piston is fitted closely to the interior surface of the cylinder 144 by means of one or more piston seals 158.

Each of the hydraulic conduits 132,142 are connected to alternate ports of a fluid control means generally 160 (typically a four-way valve). A pair of hydraulic conduits 164,166 extend between actuating ports on the control means 160 and a sensing means generally 170. There are also hydraulic conduits 168 and 172 which are connected between the sensing means generally 170 and compressing means 130,140 (and the hydraulic lines 132 and 142), respectively.

Figure 4:
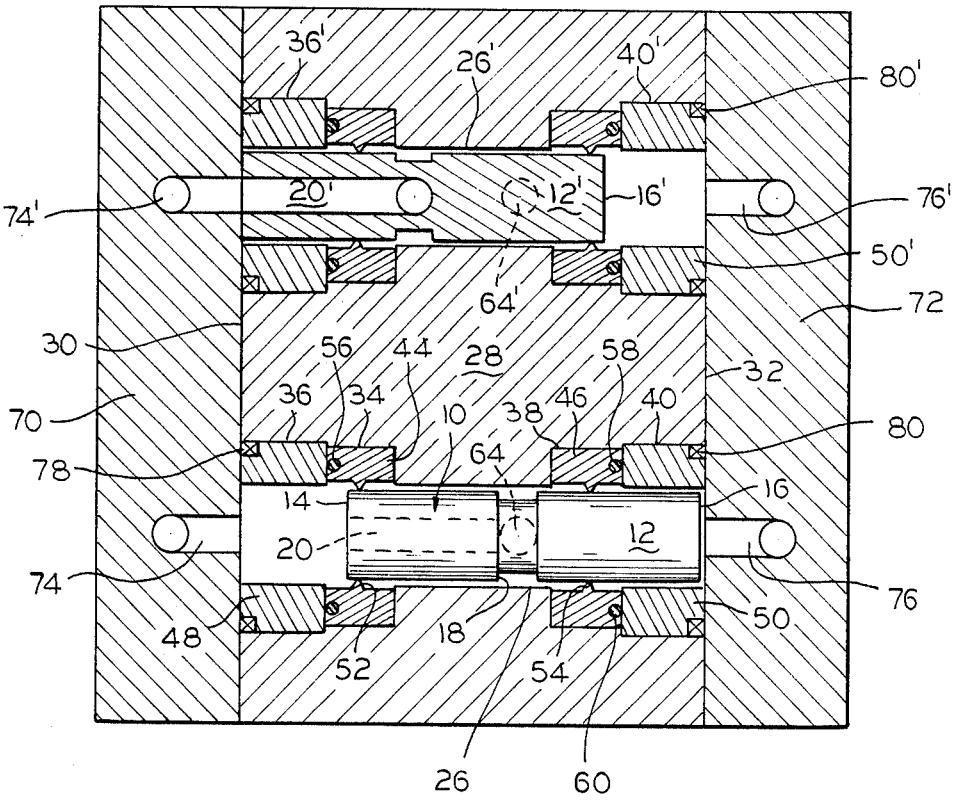
FIG. 4 is a detailed plan view of a hydraulic and gas pressure sensing means with certain parts broken away for clarity.

Details of a preferred sensing means generally 170 may be seen in FIG. 4. The details of this element of apparatus are believed to form a separate invention. The preferred sensing means for detecting changes in relative pressures between the gas in vessel 110 and hydraulic fluid in compressing means 130, on the one hand, and the gas in vessel 112 and hydraulic fluid in compressing means 140, on the other hand, comprise a mounting body 28 containing two cylindrical cavities 26,26' each in turn containing reciprocable spindles 12,12'. Each spindle has a hydraulic end face 14 and a gas end face 16 and an annular recess 18 centrally disposed thereon. Also each spindle 12 slides within hydraulic and gas seals 44,46 which are held in place in the cavities 26 by end plugs 48,50. The hydraulic end of the cavity 26 is connected through passageway 74 to hydraulic conduit 168 and thence to compressing means 130; and the gas end of the cylinder 26 is connected by passageway 76 to gas conduit 116 and thence to the vessel 110. Similarly, the respective ends of cavity 26' are connected through passageway 74' to the hydraulic conduit 172 and hence to compressing means 140 and through passageway 76' to gas conduit 118 and vessel 112.

Each spindle contains a longitudinal passageway 20 extending between the hydraulic end face 14 and the annular recess 18. A fluid outlet passageway 64 is located in the mounting body 28 at a point to be in line with the annular recess 18, when the spindle 12 has been moved to the right (as shown in FIG. 4) by reason of the fluid pressure in compressing means 130 exceeding the pressure of the gas in vessel 110. In this condition hydraulic fluid under pressure will move through passageway 20 and outlet passageway 64 which is connected to hydraulic conduit 164 which, in turn, will cause the control means 160 to move to connect the hydraulic conduit 132 to a discharge conduit 182 which leads through filter 184 to a reservoir 190.

When the control means 160 is in the aforesaid condition, the hydraulic conduit leading to compressing means 140 will be connected with a hydraulic supply conduit 174 which runs through a filter 176 to a fluid pressure means generally 180 usually a pump. It will be seen that the hydraulic fluid pressure on compressing means 140 will also be exerted through conduit 172 and passageway 74' to the hydraulic side of cylinder 26' in the mounting body 28. Previously the hydraulic fluid in the compressing means 140 and passageway 74' would have been in communication through control means 160 with the discharge conduit 182 and reservoir 190; and the gas pressure in vessel 112 acting through conduit 118, which is connected to passageway 76', would have forced the spindle 12' to the left (as seen in FIG. 4) in which position it will remain during the initial period of compressing gas within vessel 112. As pressurized hydraulic fluid is delivered to the compressing means 140 and passageway 74' to cavity 26'), the gas and hydraulic pressure will remain in substantial equilibrium and the spindle 12' will be static. However, when the gas in vessel 112 can be compressed no further, either due to the pressure becoming equal with that in the high pressure main 128 or the compressing means 140 reaching its limit of travel, the pressures will no longer stay in equilibrium and the hydraulic pressure will briefly increase to the pressure out of the fluid pressure means 180. This inbalance will cause the pressure against the hydraulic face 14' of spindle 12' to overcome the gas pressure against gas face 16' and hence the spindle 12' will move to the right thereby connecting passageway 20' with outlet passage 64' which, in turn, is connected with the hydraulic conduit 166.

Under this condition, the pressurized hydraulic fluid will be communicated to the opposite actuator of the control means 160 causing it to again reverse (the spindle 12 in cavity 26 having previously been reversed by the gas pressure exceeding the hydraulic pressure when vessel 110 is refilled with gas); and the hydraulic side of cylinder 26' along with the compressing means 140 will be discharged to the reservoir 190 while fluid under pressure is delivered from the pump 180 through hydraulic conduit 132 to both the compressing means 130, in vessel 110, and the hydraulic end of cavity 26. The cycle then repeats as above described.

The basic operation of the system of apparatus will have become clear from the foregoing description. The apparatus should also include restricted bleed lines 186,188 for hydraulic fluid, connected between the conduits 164, 166 and the discharge conduit 182. This permits a relief pathway for incompressible hydraulic fluid from the control means 160 when such fluid is trapped in either conduit 164,166 and an inactive actuator portion of the four-way valve. Also, the reservoir 190 may be provided with an electric heater 194, or the like, so as to bring the hydraulic fluid to an operating temperature prior to the time that the system is functional. An initiator valve 198 connected between the hydraulic supply conduit 174 and discharge conduit 182 permits the pump 180 to recirculate fluid directly to the reservoir 190 during warm-up. When the valve 198 is closed, thereby forcing pressurized hydraulic fluid into the system through control means 160, the operation as above described will commence.

Figure 3:
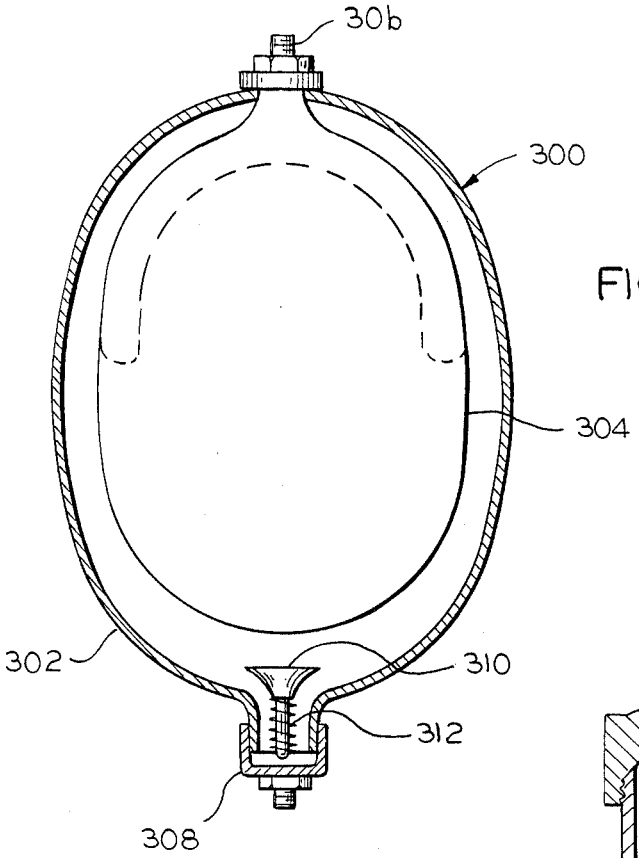
FIG. 3 is a sectional elevation of another embodiment of a gas receiving vessel and compressing means.

A further embodiment of gas receiving vessel and compressing means is shown in FIG. 3 wherein a substantially spherical chamber generally 300 is shown, in section, having curved walls 302 and containing an inflatable bladder 304 mounted internally at a gas coupling 306. At an end of the chamber 300 opposite the gas coupling 306 is a fluid coupling 308 which contains a poppet (antiextrusion) valve 310 which has a bias spring 312 urging the valve open. This apparatus may be utilized in the system of FIG. 1 by connecting the gas coupling 306 to gas conduits 116,122 (and 118,124) and by connecting the fluid coupling 308 to hydraulic conduit 132 (and 142).

In operation gas will initially inflate the bladder 304 substantially against the interior surface of the curved walls 302. The poppet valve 310 will prevent the bladder from being forced into the fluid coupling 308. When the apparatus cycles to introduce high pressure hydraulic fluid through conduit 132 and fluid coupling 308 the poppet valve 310 opens to permit passage of the fluid so as to surround the bladder 304 and gradually compress and displace it to a collapsed or nearly collapsed condition.

Particularly in the latter embodiment, but also to some extent in the embodiment shown in FIG. 2, the materials within the vessel, particularly the deformable bladder material, should be chosen so as to be compatible with both the hydraulic fluid utilized in the system and the gas for which the system is intended to be used. In addition, there will be some transmission or migration of gas into the hydraulic system, and it is preferable to choose the hydraulic fluid for both compatibility and ease of de-gassing where such migration is relatively high. Bladders may be comprised of high nitrile rubber, a fluorcarbon rubber, a silicon rubber or other flexible materials. It is believed that the high nitrile rubber or fluorcarbon rubber materials are more versatile and are preferred in systems for processing helium. There are also a number of hydraulic fluids including silicon base fluids produced by Dow Corning Company and diester base oil produced by Tenneco Inc. under the trademark "ANDEROL", and still others. It is believed that a diester base oil is comparatively easier to de-gas and is also therefore preferred in systems processing helium.

Figure 5:
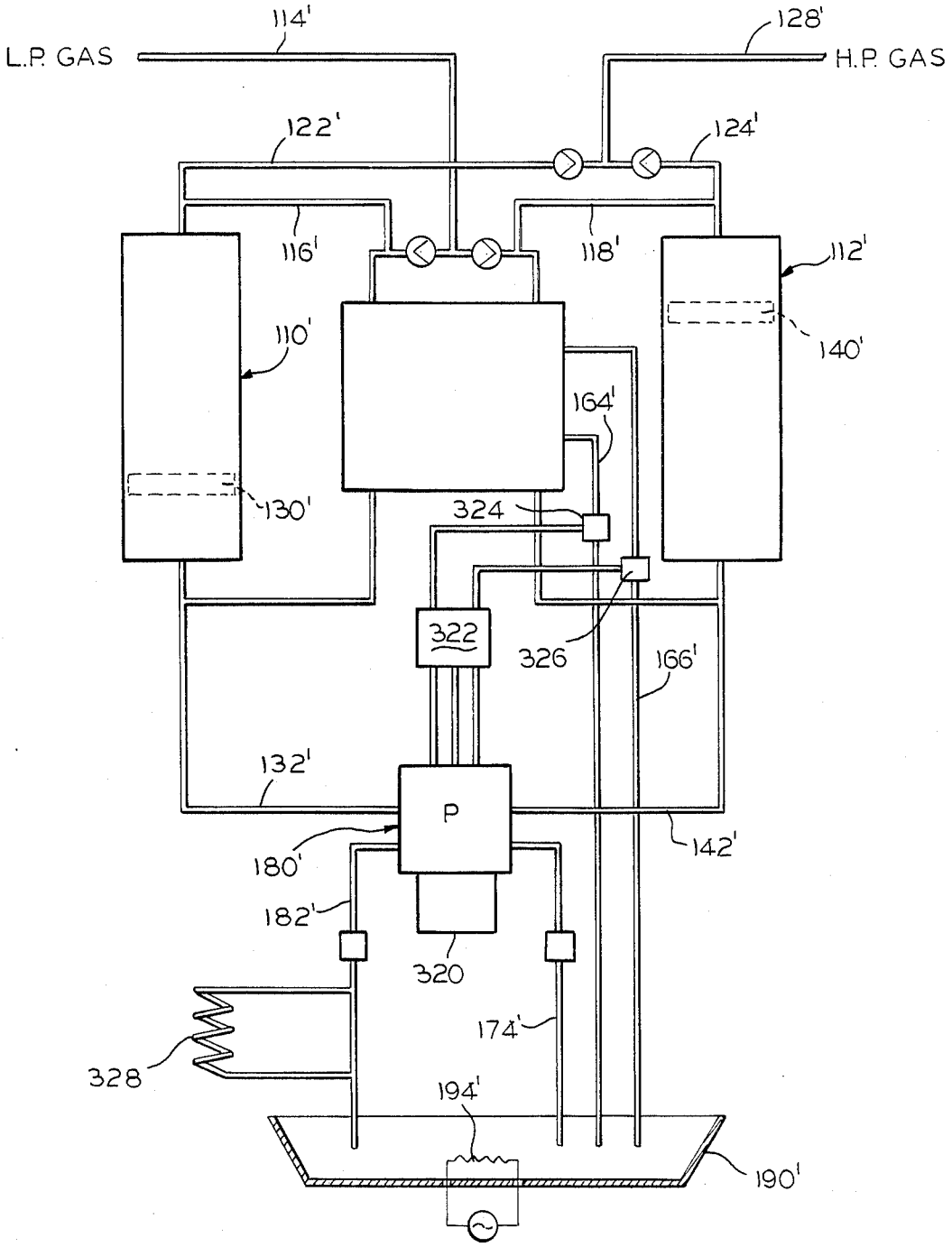
FIG. 5 is a schematic layout of a second embodiment of a system of apparatus of the present invention.

A second embodiment of a system of apparatus is shown in FIG. 5 wherein parts corresponding to those shown in FIG. 1 are denominated by the same reference characters bearing a prime notation. In this embodiment the fluid pressure means generally 180 is preferably an overcenter transmission pump driven by motor 320 and electrically connected to a directional control 322 which adjusts the pump to direct fluid under pressure to either hydraulic conduit 132' or 142' and at the same time connect the other conduit to a discharge conduit 182' and thence to the reservoir 190'. In this embodiment transducers 324 and 326 located in conduits 164' and 166' detect pressurized fluid passing through the sensing means generally 170. In this embodiment a cooler 328 is connected to discharge line 182' to remove excessive heat from the system.

Another advantage of the invention is that a large portion, often a major portion, of the heat of compression may be transferred from the compressed gas to the hydraulic fluid and dissipated through the conduits, reservoir, and where necessary a fluid cooler.

It will be apparent to those skilled in the art that still further modifications and changes may be made without departing from the scope of the invention which is defined in the following claims.

What is claimed is:

1. A method for boosting pressure of gas taken from a relatively low pressure to a higher pressure, said method comprising:

defining a compression zone and a compressing zone;

receiving an initial volume of gas at one pressure into the compressing zone;

compressing said initial volume of gas to a smaller volume and a higher second pressure by exerting force by introducing into the compressing zone a fluid available at a third pressure greater than said second pressure, the introduction of the fluid resulting in the fluid being in pressure equilibrium with said gas until the gas and the fluid reach the second pressure, the fluid being continued to be introduced into the compressing zone until the pressure in said fluid increases above said second pressure;

sensing the increase in pressure of said fluid within the compressing zone above the pressure of said gas and generating a signal upon the occurrence of said increase; and releasing the fluid at said third pressure whereby to terminate compression of said gas and to prepare to receive a subsequent volume of gas at said one pressure in said compression zone.

2. A method of claim 1, wherein during the step of compressing the said gas is transmitted at the second pressure from said compression zone to a receptacle for receiving higher pressure gas.

3. The method of claim 1, wherein compressing of said initial volume of gas is accomplished by displacing at least a portion of the initial volume in said compression zone with said fluid whereby the displaced volume of fluid will increase above said second pressure, and wherein the pressure of both said gas and said displaced volume of fluid is sensed and a portion of said fluid is diverted to generate said signal.

4. The method of claim 3, wherein upon releasing said fluid the displacement of said compression zone is restored by discharging the fluid therefrom.

* * * * *